United States Patent [19]

Fender

[11] Patent Number: 4,724,737

[45] Date of Patent: Feb. 16, 1988

[54] TUNING SYSTEM FOR VIBRATO GUITAR WITH STRING LOCK

[76] Inventor: C. Leo Fender, 1510 Dana Pl., Fullerton, Calif. 92635

[21] Appl. No.: 829,978

[22] Filed: Feb. 18, 1986

Related U.S. Application Data

[63] Continuation-in-part of Ser. No. 662,021, Oct. 18, 1984, abandoned.

[51] Int. Cl.[4] ..... G10D 3/12

[52] U.S. Cl. ..... 84/313; 84/297 R

[58] Field of Search ..... 84/297–299, 84/312–313

[56] References Cited

U.S. PATENT DOCUMENTS 1,431,250. 10/1922 Oettinger ..... 84/312 R
2,788,694 4/1957 Dearth ..... 84/312 R
3,733,954 5/1973 Fields ..... 84/312 P
4,457,201 7/1984 Storey ..... 84/313

*Primary Examiner*—Lawrence R. Franklin
*Attorney, Agent, or Firm*—Spensley Horn Jubas & Lubitz

[57] ABSTRACT

A guitar having a vibrato bridge assembly and a string lock mechanism for locking the strings at the intersection of the head and neck is provided with a fine-tuning mechanism on the bridge assembly. The tuning mechanism includes tuning knob elevator screws which are generally perpendicular to the face of the body of the guitar and which are easily accessible. Rotation of the tuning knob screws is coupled via an L-shaped rocker element to cause translational movement of the guitar strings thereby to adjust their tension and pitch. Rocker mechanisms are disclosed which minimize vibrational interference between adjacent rocker elements.

2 Claims, 13 Drawing Figures

TUNING SYSTEM FOR VIBRATO GUITAR WITH STRING LOCK

BACKGROUND OF THE INVENTION

1. Related Application.

This is a continuation-in-part of U.S. application Ser. No. 662,021, filed Oct. 18, 1984 now abandoned.

2. Field of the Invention.

This invention relates to a tuning mechanism for guitars and more particularly to a fine-tuning mechanism for electric guitars which include vibrato.

An electric guitar with vibrato includes a body, a neck and a head, with strings extending from tuning posts on the head to a vibrato bridge assembly on the body. Tuning of the strings is accomplished by tuning knobs coupled to the tuning posts on the head. The vibrato bridge assembly includes a bridge plate which is pivotally supported with respect to the body. By pivoting the bridge plate by means of a vibrato handle, the tension on the strings is altered to vary the pitch of the strings so as to achieve vibrato effects. Because of the varying tension on the strings caused by use of the vibrato, the strings may slip with respect to the tuning posts or a slight turning of the tuning posts may occur, with the result being that the strings will go out of tune. In order to prevent this occurrence, many electric guitars with vibrato incorporate a string lock machanism between the head and neck. Typically, the string lock machanism is a clamp which is used to clamp the strings in a fixed position after the guitar has been tuned. Thus, the tuning knobs are initially adjusted to tune the guitar, the string lock is then secured, and the guitar may be played and the vibrato used without causing the strings to go out of tune.

Once the string lock is engaged, the tuning knobs become inoperative. This can be disadvantageous since during the course of playing the guitar the strings may go out of tune somewhat due to various factors. It is therefore desirable to provide some method of tuning the guitar even when the string lock is engaged.

3. Description of the Prior Art

In order to overcome the inability to tune the guitar with the string lock engaged, recent vibrato guitars have been provided with a fine-tuning mechanism on the bridge of the guitar. Such mechanisms, however, are generally cumbersome and inconvenient to use. This is due primarily to the fact that the bridge assembly is located on the top face of the body of the guitar and it is difficult to provide a tuning mechanism which does not interfere with playing yet is easily accessible. In contrast to the head of the guitar, in which the string posts may be staggered so that the tuning knobs may be conveniently located, the strings are typically connected to the bridge assembly along a common line perpendicular to the strings.

Compounding the problem of providing a convenient fine-tuning mechanism is the fact that many vibrato guitars are already provided with a tuning mechanism for purposes of "octave" or "intonation" control. The purpose of such mechanisms is to ensure that the strings remain in tune even when they are pressed against the frets of the guitar to play different notes. That is, the intonation control is provided to compensate for the increase in tension in the strings which is caused by the fretting of the strings. Although a string may be in tune when a note is played which does not require any fretting, a note which does require fretting may be sharp due to the increased tension. The provision of an octave or intonation control tuning mechanism minimizes this tendency. Typically, octave or intonation control is accomplished by means of a plurality of movable saddles on the bridge assembly, with one string being supported by each saddle. The saddles are movable along the line of the strings to adjust the tension of the strings by means of a screw assembly extending to the rear of the bridge. Such mechanisms are relatively inaccessible (a screwdriver is typically used for adjustment) and are not designed for fine tuning while playing the guitar.

SUMMARY OF THE INVENTION

The present invention is directed to a guitar having a vibrato bridge assembly, a string lock for locking the strings near the intersection of the head and neck, and a fine-tuning assembly which is a part of the vibrato bridge assembly. The fine-tuning assembly is provided with easily accessible tuning knobs which form the heads of elevator screws that extend generally perpendicularly from the bridge plate and the strings. Each string is coupled to one leg of an L-shaped rocker mechanism which is pivotally attached to the bridge assembly on an axis perpendicular to the strings. The elevator screws contact the second legs of the L-shaped rocker elements and are movable perpendicular to the face of the body to pivot the rocker elements about a pivot pin. The pivoting of the rocker elements in turn alters the tension on the strings so as to achieve fine tuning. The mechanism may be provided in addition to an intonation control and will not interfere with such a mechanism.

Another aspect of the present invention is directed to an improved rocker mechanism which minimizes vibrational interference between adjacent rocker elements. Instead of pivoting about a pivot pin (a cause of such vibrational interference), the improved rocker elements of the present invention pivot about either a screw extending perpendicularly downwardly from the bridge plate, or about an edge of the bridge plate opening through which a portion of the rocker element passes.

BRIEF DESCRIPTION OF THE DRAWINGS

The invention will now be described with reference to the accompanying drawings, wherein.

DESCRIPTION OF THE PREFERRED EMBODIMENT

The following description is of the best presently contemplated mode of carrying out the invention. This description is made for the purpose of illustrating the general principles of the invention and is not to be taken in a limiting sense. The scope of the invention is best determined by reference to the appended claims.

Figure 1:
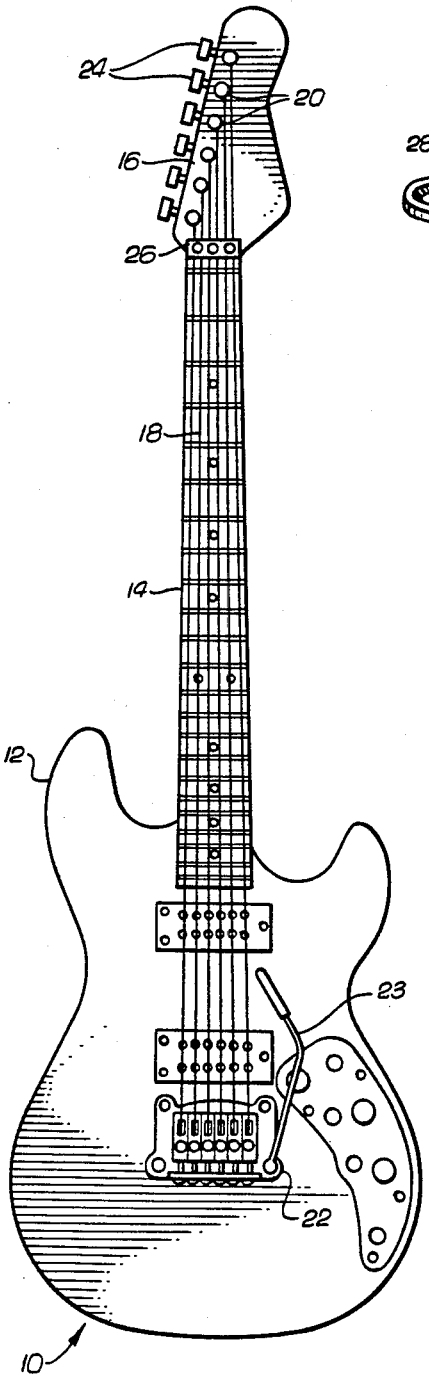
FIG. 1 is a top plan view of an electric guitar incorporating the bridge assembly of the present invention.

Referring to FIG. 1, an electric guitar 10 includes a body 12, a neck 14 and head 16. Strings 18 extend from string posts 20 on the head 16 to a vibrato bridge assembly 22 pivotally supported on the body 12. A vibrato arm 23 is attached to the bridge assembly 22 and is employed to pivot the bridge assembly so as to alter the tension on the strings and provide vibrato effects. Tuning of the strings is accomplished by means of tuning knobs 24 coupled to the string posts 20. A string lock 26 is provided at the lower portion of the head near the neck 14. The string lock assembly 26 is a clamp which is engaged after the strings have been tuned by means of the tuning knobs 24. The string lock assembly is provided so that the operation of the vibrato mechanism will not alter the settings of the tuning knobs, which would cause the guitar to go out of tune.

During the course of playing the guitar, one or more of the strings may go out of tune, thus requiring retuning. This operation is inconvenient, since it would require that the string lock be released and the tuning knobs 24 readjusted. The string lock is typically clamped by means of Allen bolts or the like and is not designed for quick locking and unlocking. This is primarily due to the fact that the string lock must have a shallow design so as to avoid interference with the playing of the guitar. The retuning of the guitar by disengaging the string lock is especially inconvenient during a performance, since the unlocking of the string lock, tuning of the guitar and subsequent relocking of the string lock is time-consuming and cumbersome.

Figure 2:
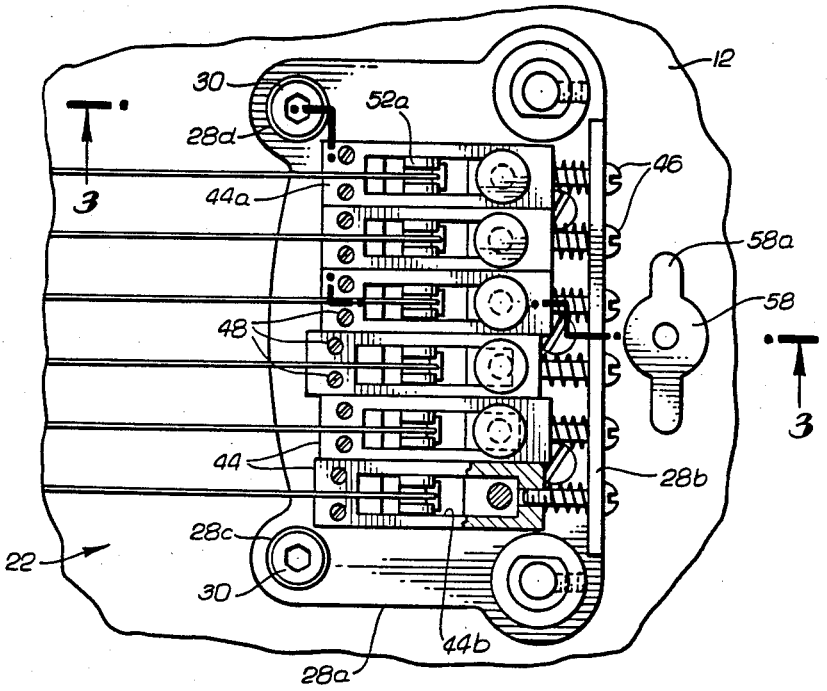
FIG. 2 is a top plan view of the bridge assembly of the present invention.
Figure 3:
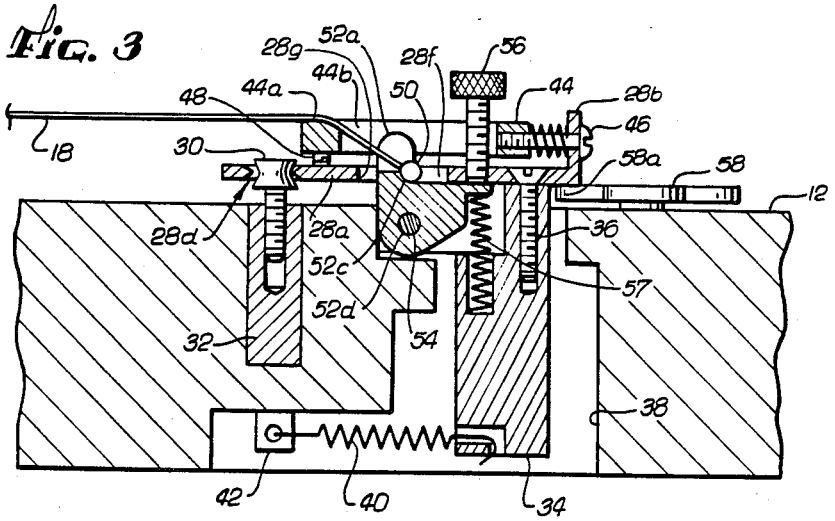
FIG. 3 is a side view in section of the bridge assembly and a portion of the body of the guitar.

In order to facilitate fine tuning of the guitar while the string lock is engaged, the bridge assembly includes a fine-tuning mechanism. One embodiment of the bridge assembly is shown in detail in FIGS. 2 and 3. The assembly includes a bridge plate 28 which is typically formed of chrome-plated steel. The bridge plate includes a main portion 28*a* and a lip 28*b* extending upwardly from the rear of the main portion. A pair of holes 28*c* and 28*d* are formed toward the front edge of the bridge plate and are formed into knife edges, as can be seen in FIG. 3. The knife edges are pivotally coupled to corresponding pivot points of the heads of support screws 30 (FIG. 3) which screw into brass anchors 32 carried in the body. A counterweight 34, which may be formed, for example, of lead, is secured to the bottom of the bridge plate by means of screws 36 (typically three) and extends through a hole 38 formed in the body. A spring 40 is secured between the bottom of the counterweights 34 and an anchor 42 attached to the surface of a recess in the bottom of the body. Typically, one to three such springs 40 are employed to provide the desired tension.

A plurality of saddle assemblies 44 is slidably mounted on the top of the bridge plate 28. Spring loaded adjustment screws 46 support the rear of the saddle assemblies, and height adjustment screws 48 support the front of the saddle assemblies. A string 18 passes over a support surface 44*a* of each saddle assembly. A string ball 50 attached to the end of each string anchors the string in a rocker element 52 as will be described subsequently. By turning the screws 46, the saddle assemblies 44 may be moved toward or away from the head of the guitar so as to adjust the tension on the strings. The movable saddle assemblies are known in the art and provide intonation control for the guitar.

Figure 5:
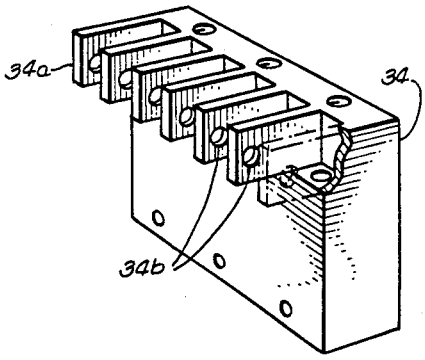
FIG. 5 is a perspective view of a counterweight which forms a part of the bridge assembly.

In addition to intonation control, the present invention provides a separate tuning system for rapid and convenient fine tuning of the guitar. The rocker element 52 is a generally L-shaped element having a first leg 52*a* which is generally perpendicular to the surface of the body 12 and a second leg 52*b* which is generally parallel to the surface of the body 12. As can be seen in FIG. 5, the counterweight 34 includes integral fins 34*a* having aligned holes 34*b*. Each rocker element 52 fits between adjacent fins and is pivotally supported by a rod 54 (FIG. 3) passing through the holes 34*b* of the counterweight and through holes 52*d* in the rocker elements.

Figure 6:
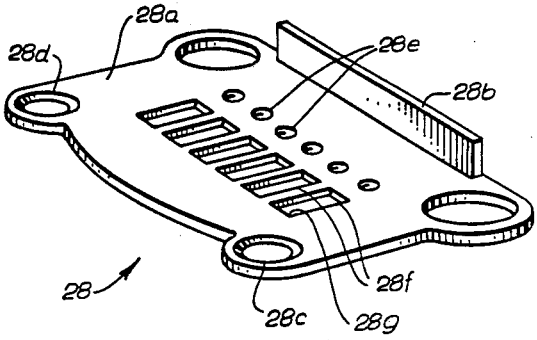
FIG. 6 is a top plan view of a bridge plate which forms a part of the bridge assembly.

Each saddle element 44 has a generally rectangular frame member with a central opening 44*b*. The first leg 52*a* of a rocker element extends into the opening. In addition, an elevator screw 56 having a tuning knob at its top passes through the opening and into a threaded hole in the bridge plate 28. The bottom of the elevator screw 56 contacts the second leg 52*b* of a rocker element. There is one saddle assembly, rocker element and elevator screw for each string of the guitar. As shown in FIG. 6, the bridge plate 28 includes rectangular openings 28*d* through which the first legs 52 of the rocker members extend and threaded openings 28*e* through which the elevator screws are threaded.

In order to fine tune the guitar strings, the elevator screws are turned in order to pivot the rocker members 52 about the rod 54. The pivoting about the rod 54 causes translational movement of the first leg 52*a* in a direction parallel to the direction of the strings. The tension of the strings is thus altered, thereby changing their pitch. Thus, it can be seen that although the elevator screws 56 are oriented in a direction generally perpendicular to the body 12 and are thus quite accessible, their movement in a direction perpendicular to the body results in a movement of the first legs of the rocker members in a direction having a component parallel to the surface of the body. In the present embodiment of the invention, the rocker element provides a range of movement of the strings of approximately onequarter inch.

Figure 4:
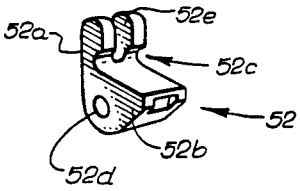
FIG. 4 is a perspective view of a rocker element used in the bridge assembly.

The rocker members are illustrated in detail in FIG. 4. The first leg 52*a* includes a recess 52*c* for seating a string ball. The string is passed through a slit 52*e* which is narrower than the diameter of the string ball. The string is thereby retained by the rocker member.

Referring again to FIGS. 2 and 3, a bridge plate lock or spacer 58 is pivotally secured to the body at a location to the rear of the bridge plate 28. The lock 58 includes an extension 58*a* which, when the lock is pivoted to the proper orientation, is wedged between the face of the body and the bottom of the bridge plate. This orientation is illustrated in FIG. 3. During the initial tuning of the guitar, the bridge plate lock is engaged and the bridge plate support screws 30 are adjusted so that the bridge plate is parallel to the surface of the body 12. The strings 18 are then tuned by means of the tuning knobs 24 and octave control screws 46. The bridge plate lock is then pivoted to the orientation shown in FIG. 2, so that the bridge plate is freely pivotable for vibrato effects. In the event that one of the strings breaks, the overall tension provided by the strings would be reduced and the tension of the spring 40 would tend to pivot the bridge plate downward, thus increasing the tension on the remaining strings and causing them to go sharp. In order to avoid this occurrence, whenever a string break occurs the bridge plate lock may be engaged to prevent the bridge plate from pivoting past the level position. In this configuration, the vibrato control arm 23 may still be used to pivot the bridge plate upward to provide vibrato effects.

Thus, a guitar is provided which has vibrato capability, a string lock for preventing use of the vibrato from interfering with the tuning of the strings, and a fine-tuning mechanism to facilitate tuning of the strings while the string lock is engaged.

Another aspect of the present invention is directed to facilitating the elimination of interfering vibrations caused by the pivot rod 54 (FIG. 3), and to strengthen the rocker mechanism and simplify manufacturing of the fine tuning assembly.

Figure 8:
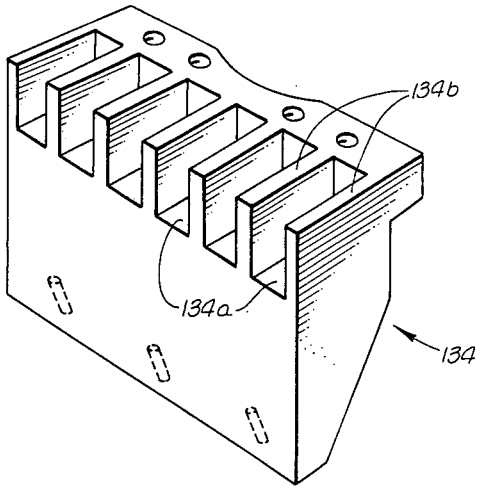
FIG. 8 is a perspective view of another embodiment of a counterweight used with the rocker element of FIG. 7.
Figure 7:
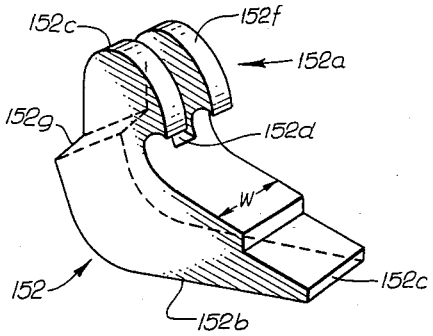
FIG. 7 is a perspective view of another embodiment of a rocker element used in the bridge assembly.
Figure 9:
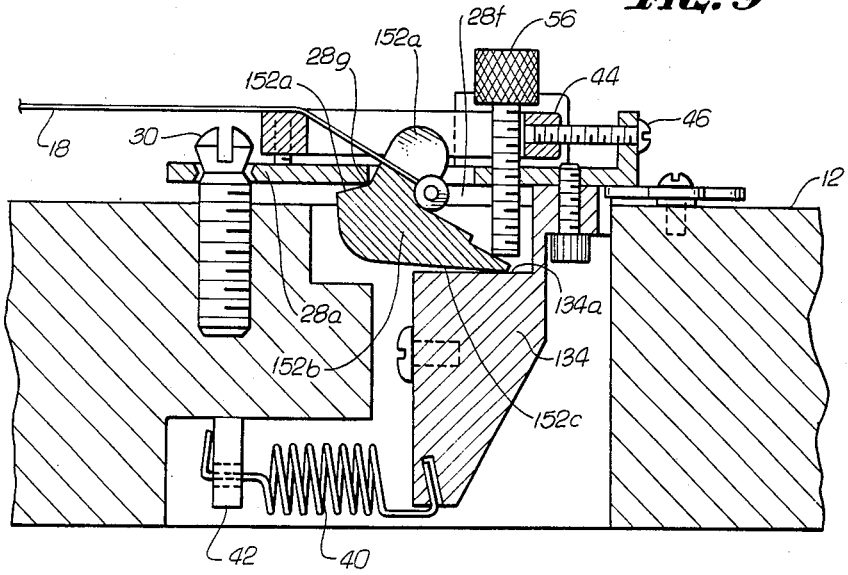
FIG. 9 is a sectional side view of the bridge assembly using the rocker element and counterweight shown in FIGS. 7 and 8, respectively, and a portion of the body of the guitar.
Figure 10:
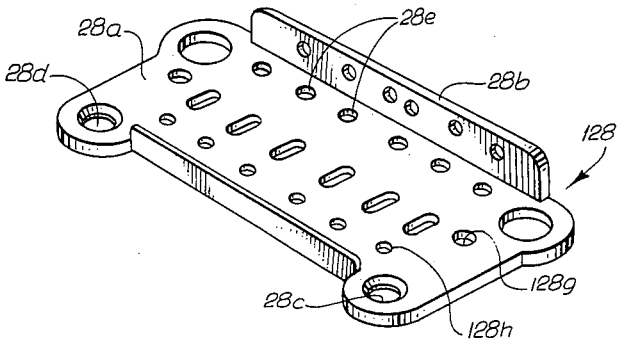
FIG. 10 is a perspective view of another embodiment of a bridge plate of the present invention.
Figure 11:
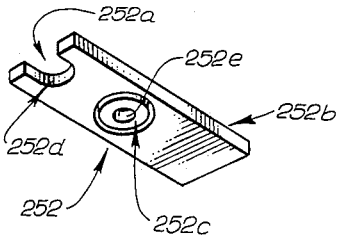
FIG. 11 is a perspective bottom view of another embodiment of a rocker element used in the bridge assembly.
Figure 12:
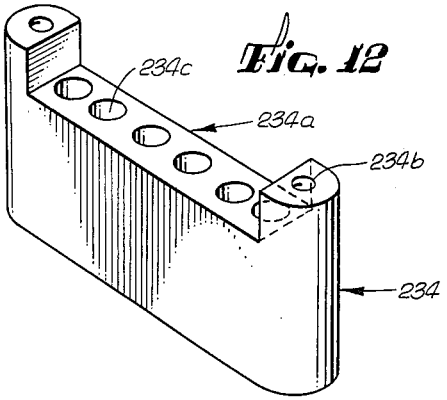
FIG. 12 is a perspective view of another embodiment of a counterweight used with the rocker element of FIG. 11.
Figure 13:
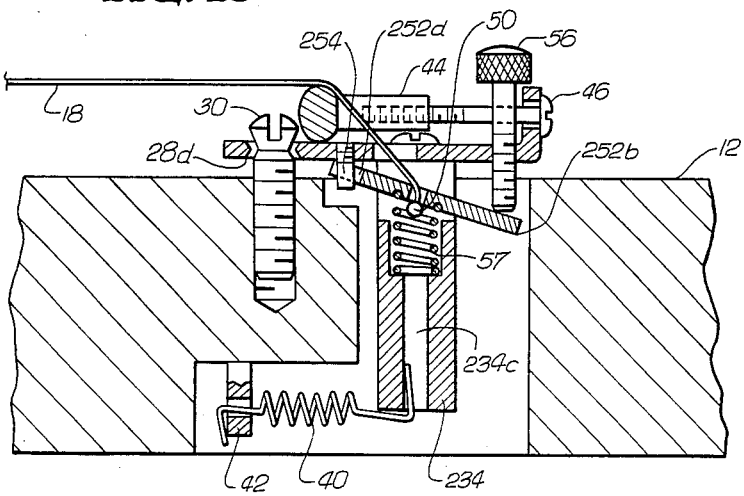
FIG. 13 is a sectional side view of the bridge assembly using the bridge plate, rocker element and counterweight shown in FIGS. 10, 11 and 12, respectively, and a portion of the body of the guitar.

With reference to FIGS. 7–9, one embodiment of this aspect of the present invention includes rocker element 152. Rocker element 152 is a generally L-shaped element having a first leg **152*a* which is generally perpendicular to the surface of the guitar body 12 and a second leg 152*b* which is generally parallel to the surface of the guitar body 12. Counterweight 134 (FIG. 8) includes ledges 134*a* spaced between integral fins 134*b*; each rocker element leg 152*b* fitting between adjacent fins and capable of contacting a counterweight ledge 134*a*. Thus, when elevator screw 56 is fully turned (FIG. 9), the lower portion 152*c* of the rocker element 152 rests on ledge 134*a* of the counterweight 134**.

The first leg **152*a* includes string ball seating recess 152*d* spaced between parallel curved side portions 152*e*, *f*. The outer surface of the curved portions 152*e*, *f* intersect with planer shoulder 152*g* at a pivot edge "1" (dotted in phantom) extending linearly along with width "w" of the rocker element 152. As shown in FIG. 9, the pivot edge "1" contacts sharp lower edge 28*g* of the bridge plate opening 28*f*. Since the tension of string 18 biases the second leg 152*b* of the rocker element 152 towards the bridge plate, the lower edge 28*g* of the bridge plate functions as a fulcrum as the rocker element 152 pivots due to movement of the elevator screw 56. By using the rocker element pivot edge "1" together with the bridge plate edge 28*g* as a pivot mechanism for the rocker element 152, need for the rod 54** is eliminated thereby substantially eliminating undesired vibrational interference between adjacent rocker elements translated by the rod. This structural change also provides a more solid mounting for the rocker element with accompanying simplification in manufacturing.

With reference to FIGS. 10–13, another embodiment of the rocker mechanism of the present invention is shown. The rocker element 252 is a generally thin plate having a semi-oval cutout **252*a* and a support end 252*b*. A plurality of rocker elements 252 fit within unobstructed recess 234*a* of counterweight 234. The bottom of rocker element 252 includes seat or recess 252*c* for retaining spring 57. String 18 passes through a hole 252*e* and is anchored by string ball 50. In the event that the string 18 breaks, the string ball 50 is guided by the spring 57 through an opening 234*c* in the counterweight 234 and out the bottom of the guitar thereby avoiding any disturbance. Bridge plate 128 is attached to counterweight 234 using screws (not shown) passing through bridge plate holes 128*g* and counterweight holes 234*b***.

Rocker element end **252*a* includes pivot rim or edge 252*d* which contacts screws 254 which extend perpendicularly downwardly through openings 128*h* of bridge plate 128. Due to movement of elevator screw 56 and the bias provided by the tension of springs 18 and 57, the rocker element 252 can pivot about the screw 254. Thus, like rocker element 152 as compared to rocker element 52, the need for rod 54 is eliminated thereby minimizing vibrational interference problems. Moreover, this particular rocker element 252 is structurally simpler than the other rocker elements 152 and 52** thereby facilitating manufacture of the bridge assembly.

What is claimed is:

1. A guitar having vibrato, comprising:

a body section having an upper face;

a neck section extending from the body section;

a head section attached to the neck section;

a plurality of tuning members attached to the head;

a plurality of strings, one each connected to a tuning member and extending across the neck section and face of the body;

a string lock assembly located toward the neck from the tuning members for locking the strings in a fixed position;

support means secured to the body section and extending from the face thereof;

a bridge assembly to which the strings are secured, said bridge assembly being pivotally supported with respect to the base by the support means, said bridge assembly including:

a bridge plate spaced from and generally parallel to the face of the body, the bridge plate including a plurality of openings, each having an edge;

a plurality of saddle assemblies carried on the bridge plate and movable toward and away from the neck, each saddle assembly supporting a string thereon and having an opening aligned with the bridge plate rectangular openings;

a plurality of generally L-shaped rocker elements, one associated with each saddle assembly, the rocker elements being pivotally connected at the edge of the bridge plate opening and being pivotable about said bridge plate edge, each rocker element including a first leg having a main portion extending substantially perpendicular to the bridge plate and a shoulder extending toward the head section and away from the main portion and a second leg, the intersection of the shoulder and the main portion of the first leg providing a pivot edge, wherein a tensioned guitar string passes over a saddle assembly and is secured to the first leg of an associated rocker element to thereby bias the second leg towards the bridge plate; and a plurality of adjustment screws, one passing through each saddle assembly generally perpendicular to the bridge plate and contacting the second leg of the associated rocker element to thereby bias the second leg away from the bridge plate, wherein movement of the adjustment screw causes the rocker element to pivot about the bridge plate opening edge thereby altering the tension on the guitar string.

2. A guitar having vibrato comprising:

a body section having an upper face;

a neck section extending from the body section;

a head section attached to the neck section;

a plurality of tuning members attached to the head;

a plurality of strings, one each connected to a tuning member and extending across the neck section and face of the body;

a string lock assembly located toward the neck from the tuning members for locking the strings in a fixed position;

support means secured to the body section and extending from the face thereof; and a bridge assembly to which the strings are secured, the bridge assembly being pivotably supported with respect to the base by the support means, the bridge assembly including:

a bridge plate spaced from and generally parallel to the face of the body, the bridge plate including a plurality of sets of first, second and third openings, the second opening having an edge adjacent the first opening;

a plurality of saddle assemblies carried on the bridge plate and movable toward and away from the neck, each saddle assembly supporting a string thereon and having an opening alligned with a bridge plate second opening;

a plurality of generally planar rocker elements each having two ends, one rocker element associated with each saddle assembly, the rocker elements being pivotably connected at the edge of the second opening of the bridge plate and being pivotable about said bridge plate edge, wherein a pivot screw passes through the first opening of the bridge plate and an adjustment screw passes through the third opening of the bridge plate in the direction of the pivot screw and parallel to the pivot screw, one end of the rocker element pivotably coupled to the pivot screw and the other end of the rocker element touching the free end of the adjustment screw, the string connected to the rocker element and biasing the other end of the rocker element towards the bridge plate, wherein movement of the adjustment screw causes the rocker element to pivot about the bridge plate edge thereby altering the tension on the guitar string.

* * * * *